United States Patent [19]

Schulz

[11] 4,287,613

[45] Sep. 8, 1981

[54] HEADGEAR WITH ENERGY ABSORBING AND SIZING MEANS

[75] Inventor: Arthur M. Schulz, Roselle, Ill.

[73] Assignee: Riddell, Inc., Des Plaines, Ill.

[21] Appl. No.: 194,351

[22] Filed: Oct. 6, 1980

Related U.S. Application Data

[63] Continuation-in-part of Ser. No. 56,273, Jul. 9, 1979, abandoned.

[51] Int. Cl.[3] ..... A42B 3/02

[52] U.S. Cl. ..... 2/413; 2/414; 2/420

[58] Field of Search ..... 2/413, 414, 411, 412, 2/415, 417, 418, 419, 420, 410, 6

[56] References Cited

U.S. PATENT DOCUMENTS 3,609,764 10/1971 Morgan ..... 2/414

3,882,547 5/1975 Morgan ..... 2/414

FOREIGN PATENT DOCUMENTS 919352 1/1973 Canada ..... 2/413

*Primary Examiner*—Peter P. Nerbun

*Attorney, Agent, or Firm*—McDougall, Hersh & Scott

[57] ABSTRACT

A headgear comprising a helmet shell and a combination of energy-absorbing and sizing means mounted on the inside surface of the shell. The combination includes a crown-engaging structure either in the form of a web suspension or an air-inflatable means. These pad structures comprise curved assemblies which engage the forehead and back of the wearer's head and the pad structures enable automatic alignment of the helmet along the long axis of the head whereby the air-inflatable side members are operated after the helmet has been put on the head. Air inflatable sizing means are located intermediate the pad structures at the front and back of the shell, and these sizing means engage the respective sides of the werer's head to provide a side-to-side fit on the head. A combination serving as a sizing means and energy-absorbing means is located on the lower rear inside wall of the shell. Separate energy-absorbing pad structures are located on the front and back inner walls of the shell.

9 Claims, 7 Drawing Figures

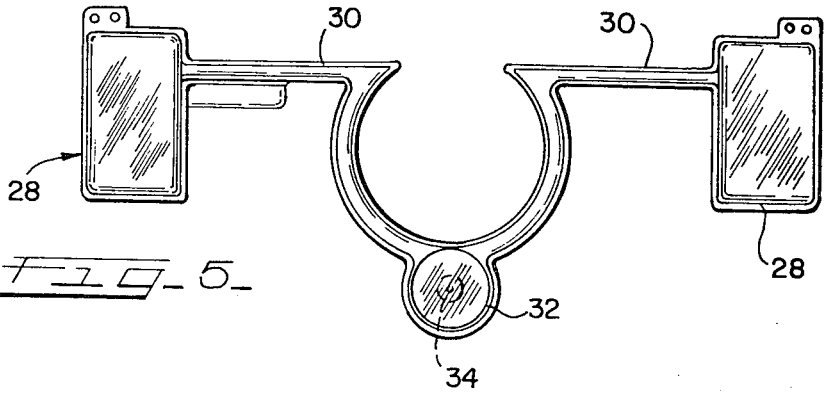
Fig. 5
Fig. 6
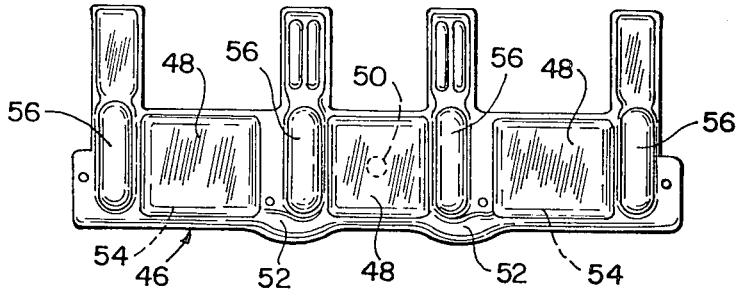
Fig. 7
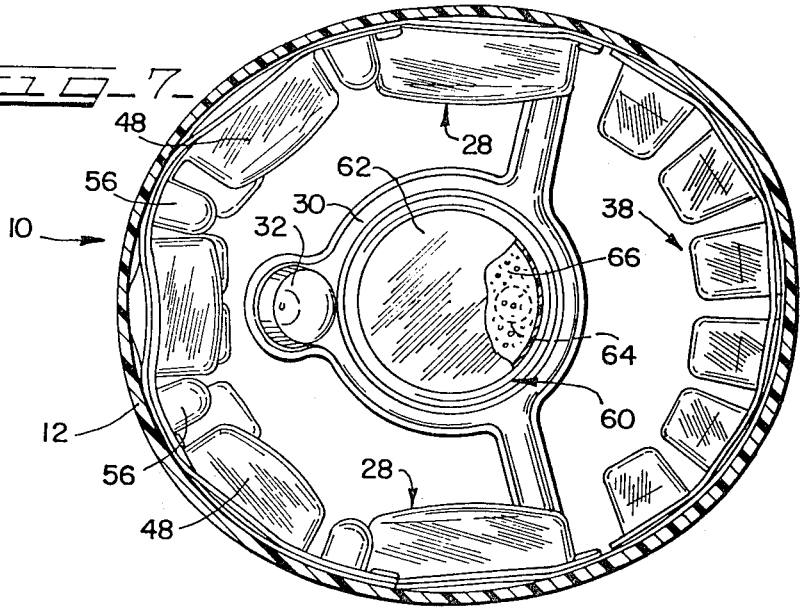

HEADGEAR WITH ENERGY ABSORBING AND SIZING MEANS

The application is a continuation-in-part of Ser. No. 56,273, filed July 9, 1979, now abandoned upon which priority is claimed.

BACKGROUND OF THE INVENTION

This invention relates to protective helmet constructions. Generally speaking, such constructions include mechanisms which are employed for receiving impact forces and for dissipating the forces in order to reduce the adverse affects of the impact. Such constructions typically utilize sizing means to permit adaptation of a given helmet to different individuals and in order to maximize the energy-absorbing characteristics.

A wide variety of helmet structures have been designed for absorbing energy since there are many circumstances where individuals are susceptible to impact forces which could result in serious head injuries. In certain instances, the forces arise when the head strikes a more or less stationary object such as a wall or an automobile dashboard. In other instances, the forces arise due to impact which results when another object moves into contact with the individual. This may occur in contact sports such as football, or the impact forces could result when workmen are struck by falling objects.

A proper fit, in addition to energy-absorbing means, is also of importance in helmet constructions. Provisions may be made for fitting by providing a head cradle, usually composed of a plurality of straps, along with some means for adjusting the straps. This is, however, somewhat unsatisfactory since completely accurate adjustments are difficult to make, and since the adjustments can not be made while the helmet is on the head. This has led to the use of air-inflatable sizing means as described in Morgan U.S. Pat. No. 3,713,640.

To provide a proper fit, helmet manufacturers make available a complete range of sizes of helmets. This leads to additional costs both from the standpoint of manufacturing and due to the fact that users of the helmets must secure large inventories in order to accommodate different individuals and to permit immediate replacement.

The use of a web suspension system as described in Riddell U.S. Pat. No. 2,359,387 has met with considerable success. More recently, energy-absorbing mechanisms which do not require the use of webbing have been developed, for example as described in Morgan U.S. Pat. Nos. 3,609,764 and 3,713,640.

Morgan Pat. No. 3,882,547 is particularly addressed to an energy-absorbing and sizing structure. The structure is characterized by a resilient padding arrangement which is adapted to be manufactured in different sizes whereby the equipment can be fit to the requirements of different wearers, and the padding structure is also characterized by the ability to absorb the force of impacts in a highly efficient manner irrespective of the particular fitting requirements. The structure consists of a housing of substantially air-impervious material containing a sandwich comprising a first layer of slow-recovery resilient material and a second layer of a softer resilient material. The softer material is adapted to be included in various thicknesses to accommodate different fitting requirements whereby the padding structure can be utilized for wearers having substantially different needs. The fitting material is of a density such that it will be normally slightly compressed without affecting the slow-recovery material so that the impact-attenuating ability of the latter is not affected. The housing for the sandwich preferably defines at least one small opening whereby air is adapted to be discharged from the housing in response to an impact for thereby assisting, e.g. to the extent of about 10 percent, in absorbing the force of the impact.

SUMMARY OF THE INVENTION

This invention relates to a particular combination of energy-absorbing and sizing means whereby the advantageous features of the respective structures can be utilized to maximum advantage. The combination includes a crown-engaging structure either in the form of a web suspension or an air-inflatable means. In both instances, an energy-absorbing, resilient material is utilized in the area between the crown-engaging means and the helmet shell whereby high impact forces cannot result in contact between the shell and the wearer's head.

Separate energy-absorbing pad structures are located on the front and back inner walls of the shell. These structures preferably utilize distinct types of padding material for purposes of achieving energy absorption depending upon the level of impact forces applied to the helmet.

The pad structures come in a range of sizes and are removably mounted so that varying sizes of headgear can be achieved. Furthermore, the pad structures take the form of curved assemblies which engage the forehead and back of the head so that alignment along the long axis of the head is automatically achieved.

The combination further includes side-mounted, air-inflatable sizing means located intermediate the pad structures at the front and back of the shell. These sizing means engage the respective sides of the wearer's head, and they permit precise positioning of the shell on the head.

The structure also includes a combination of sizing means and high-energy absorbing means on the lower rear inside wall of the shell. The sizing means may comprise air-inflatable means for fitting purposes. The energy-absorbing means may be of a type including first fluid holding chambers communicating with adjacent smaller chambers. In response to high impact, the fluid is temporarily displaced into the smaller chambers and then returned upon removal of the impact force.

Alternatively, pad structures mounted on the rear inside wall may be used for fitting and energy absorbing purposes. The pad structures may be removably mounted so that pads of varying thicknesses can be used to vary the fit.

BRIEF DESCRIPTION OF THE DRAWINGS

FIG. 5 is a plan view of the sizing means utilized in combination for engaging the sides of the wearer's head;

FIG. 6 is a plan view of the energy absorbing and sizing structure utilized in the combination for placement on the lower rear inside wall of the helmet shell; and, FIG. 7 is a horizontal cross-sectional view illustrating an alternative crown engaging structure.

DETAILED DESCRIPTION OF THE PREFERRED EMBODIMENTS

Figure 1:
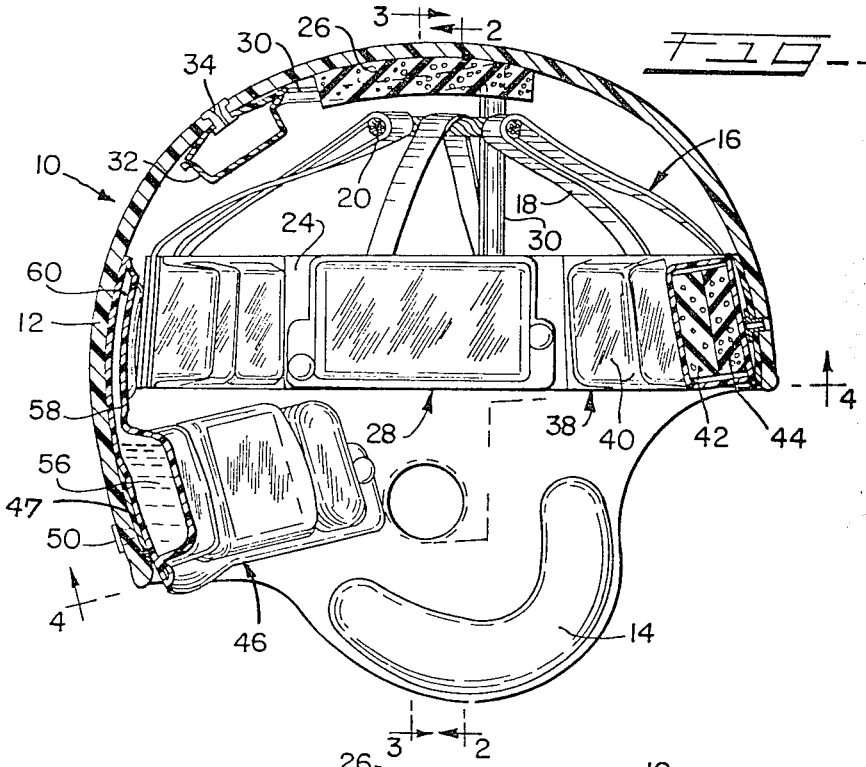
FIG. 1 is a cross-sectional view of a helmet construction characterized by the combination of this helmet.
Figure 2:
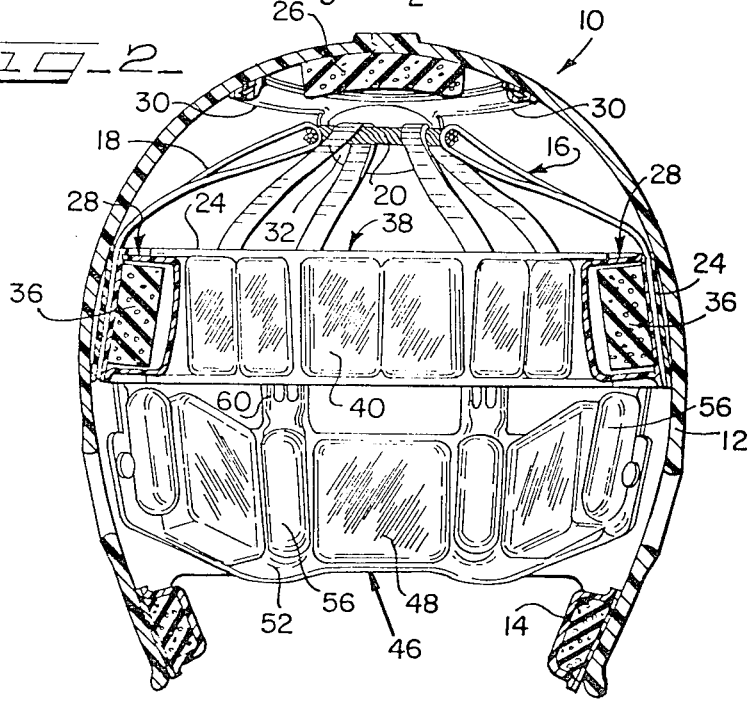
FIG. 2 is a vertical, cross-sectional view of the helmet taken about the line 2—2 of FIG. 1.
Figure 3:
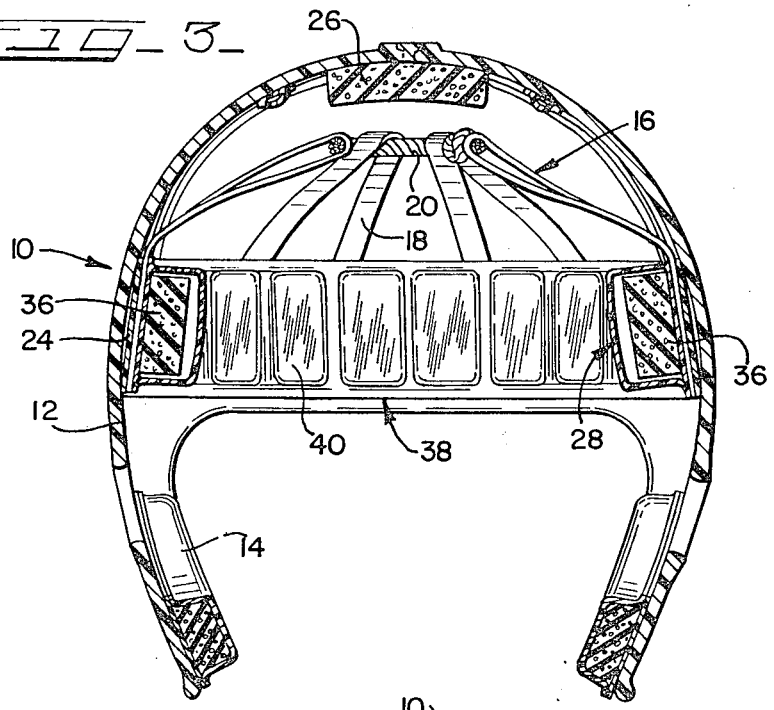
FIG. 3 is a vertical, cross-sectional view of the helmet taken about the line 3—3 of FIG. 1.
Figure 4:
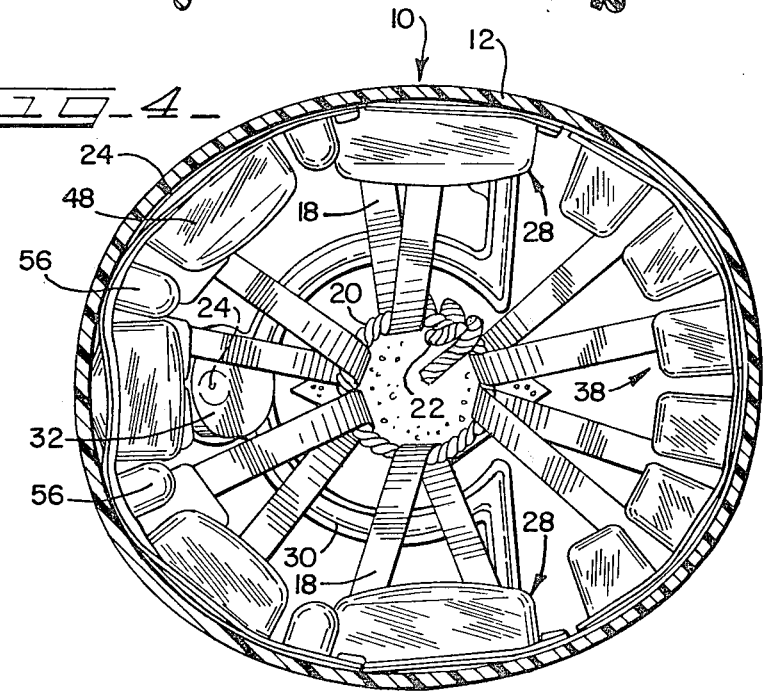
FIG. 4 is a horizontal-sectional view taken about the line 4—4 of FIG. 1.

FIGS. 1 through 5 illustrate a headgear 10 of the type utilized by football players. The structure includes a helmet shell 12 of plastic material, typically a polycarbonate. Pads 14 are attached in conventional fashion on the inner wall of the shell for the protection in the cheek area. Additional energy absorbing and sizing-means are located over the inner wall of the shell in the particular combination of the invention.

The additional structures referred to include a web suspension means 16 comprising a plurality of straps 18 and a cord 20. The latter is threaded through loops formed by the respective straps and knotted at 22. The ends of the straps are connected to an encircling band 24 which is fastened at selected locations to the shell. This band may comprise a strip of relatively stiff plastic, and it may be releasibly attached whereby the structures supported by the band can be replaced. The aforementioned U.S. Pat. No. 3,882,547 describes one means for attaching a band of this type.

A resilient pad 26 is attached to the crown of the helmet. The web suspension means is intended to maintain the top of the wearer's head out of contact with the upper wall of the helmut shell. The pad 26 is provided as an intermediate barrier but is not likely to be functional during normal use of the headgear.

The band 24 also supports a pair of air inflatable compartments 28, the assembly including these compartments being shown particularly in FIG. 5. These compartments are attached to the band in a position for engagement with the opposite sides of the wearer's head. Each compartment is connected to an air inflation conduit 30 with each conduit extending to a distributing compartment 32. An air inflation valve 34 communicates with this distributing compartment whereby the introduction of air under pressure into compartment 32 provides for the introduction of the air into the respective chambers 28. Similarly, the valve 34 can be utilized for reducing the inflation of the compartments 28.

The compartments 28 each have a section of resilient padding 36 located therein. Although the compartments 28 primarily serve a sizing function, the padding 36 provides an additional energy-absorbing function. Thus, an impact received by the helmet shell will result in compression of a compartment 28 to absorb some energy, and if the impact is of sufficient force, compression of the pad 36 will occur whereby an additional energy-absorbing function is achieved.

An assembly 38 of energy-absorbing means is positioned between the compartments 28 on both the front and rear walls of the helmet shell. Each assembly comprises a plurality of compartments 40 mounted on strip 24. Each compartment is filled with plastic padding material, and this material may comprise the combination of materials as described in the aforementioned U.S. Pat. No. 3,882,547. Specifically, an outer layer 42 of material may comprise a relatively soft material which is readily compressible. The inner layer 44 will, on the other hand, be formed from a relatively stiff, substantially less compressible plastic. As described in that patent, the latter may be selected from a "slow-recovery" category of plastic foam whereby its significant function will occur when particularly heavy impact forces are encountered.

The assemblies 38 may be provided in different sizes whereby a sizing function can also be achieved with such assemblies. Specifically, the structures 40 may have thicknesses of, for example, $\frac{7}{8}''$, 1" and $1\frac{1}{8}''$. Using only two different helmet shell sizes, ten variations in helmet sizes can then be achieved.

It will be noted that these assemblies consist of rows of closely-spaced compartments 40, and that the sizing compartments 28 substantially fill the space between the ends of the rows. In practice, the helmet is placed on the user's head before inflation of compartment 28. Due to the curvature of the front and back assemblies of pads 40, the helmet will be automatically aligned along the long axis of the head. This insures equal inflation of side compartments 28 and a comfortable fit.

An additional assembly 46 is located on the lower inside rear wall surface of the helmet shell. This assembly is shown in FIG. 6, and it consists of spaced-apart sizing compartments 48. A valve 50 communicates with the exterior of the shell, and this valve is adapted to introduce air into central compartment 48. Passages 52 communicate the central compartment with the other compartments 48 whereby the pressure within the compartments, and thus the size of the compartments can be regulated. These compartments thus achieve a sizing function while the resistance of the compartments to pressure will achieve some energy absorbing function. Pads 54 are preferably included within the compartments to provide additional energy-absorbing capability. A further discussion of a suitable arrangement can be found in the aforementioned U.S. Pat. No. 3,713,640.

A plurality of liquid holding chambers 56 are also included in the assembly 46. As best shown in FIG. 1, the chambers 56 communicate by means of passages 58 with normally flattened chambers 60. This combination of chambers and the liquid within the chambers achieves a particularly valuable function when severe impact forces are encountered. As explained in the aforementioned U.S. Pat. No. 3,713,640, displacement of liquid from a chamber 56 into a chamber 60 provides for a high degree of energy absorption, and the original condition of the chambers is quickly restored when the impact force is removed.

The assembly 46 is mounted on a strip 47 of relatively stiff plastic which is preferably releasibly attached to the shell so that assemblies of different sizes can be used. It will be noted that the assembly 46 is substantially co-extensive with the rear row of pad structure compartments 40.

As an alternative to assemblies 46, the lower rear portion of the shell may use pad structures in this area such as shown in the aforementioned U.S. Pat. No. 3,882,547.

FIG. 7 illustrates an alternative form of the invention wherein an assembly 60 is substituted for the web suspension 16. Thus, the assembly 60 includes a centrally located compartment 62 having a valve 64 communicating therewith. This valve serves to introduce air into the compartment 62 whereby the lower surfaces of the compartment will be engaged by the wearer's head. Since the pressure of the air within the compartment can be controlled by the valve, the compartment 62 serves the sizing function of the web suspension 16. This arrangement provides the advantage of permitting adjustments while the helmet is on the wearer's head.

As shown in FIG. 5, the assembly including sizing compartments 28 includes a central opening adapted for the receipt of assembly 60. The valve of this sizing means as with sizing means 28 and 48 is independently operated to provide selectivity in sizing. It is contemplated, however, that the assembly of FIG. 5 could be formed integrally with the assembly 60, and a single valve could then be utilized for achieving inflation of the compartments 28 and compartment 62. Reference is made to the aforementioned U.S. Pat. No. 3,713,640 relative to the utilization of a structure such as assembly 60 in the crown area of a helmet. In that connection, resilient padding material 66 is preferably included within the compartment.

The foregoing description teaches a highly efficient combination of elements for use in association with a headgear. The sizing means described achieve selectivity in all essential respects while minimizing the need for parts of different sizes to fit different individuals. The energy-absorbing characteristics of the helmet, on the other hand, are similarly located in a strategic fashion whereby the most satisfactory results known to applicant can be accomplished.

It will be understood that various changes and modifications may be made in the above described construction which provide the characteristics of the invention without departing from the spirit of the invention particularly as defined in the following claims.

I claim:

1. In a headgear construction comprising a helmet shell, and a plurality of sizing and energy-absorbing means mounted on the inside surface of the shell for engaging the wearer's head, the combination of the sizing and energy absorbing means comprising a crown-engaging means including means for varying the distance between a head engaging portion of the crown-engaging means and said shell surface for thereby controlling the fit of the heargear, energy-absorbing means associated with the crown-engaging means whereby high impact forces do not result in contact between the shell and the wearer's head, and the combination including energy absorbing and sizing means located on the front and back, the sides, and the lower rear inside shell surfaces, the energy absorbing and sizing means on the side surfaces including air-inflatable means defining a side-to-side fitting dimension for the headgear, and first means for controlling the inflation of the air-inflatable means to control the side-to-side fitting dimension, said first means operating independently of said means for varying the distance between said head engaging portion and said shell, and second means for controlling the fit of the energy absorbing and sizing means on the lower rear surface operating independently of said first means, and also independently of said means for varying the distance between said head engaging means and said shell, the improvement wherein the sizing and energy-absorbing means located on the front and back surfaces of the shell comprise pad structures defining a fixed, non-inflatable front-to-back fitting dimension by said headgear, said pad structures being curved to thereby embrace the forehead and back of the wearer's head whereby the helmet is centered relative to the long axis of the head prior to inflation of said air inflatable means, and means releasibly retaining said pad structures on said front and back surfaces whereby pad structures of different dimensions may be located thereon, and whereby the fit of the helmet may thereby be varied.

2. A construction in accordance with claim 1 wherein said crown-engaging means comprises a plurality of straps each having its ends attached to the helmet shell and each extending toward the center of the helmet shell to form a web suspension, and a cord extending through the loops formed by the respective straps between their ends, said cord being adjustable for thereby controlling the sizing of the suspension.

3. A construction in accordance with claim 1 wherein said crown-engaging means comprises an air-inflatable means, and means for independently controlling the inflation of the crown-engaging air-inflatable means for thereby controlling the fit of the headgear.

4. A construction in accordance with claim 1 wherein said pad structures are of a type including separate layers of resilient material, said layers comprising a first layer of slow-recovery material disposed immediately adjacent the shell surface and a second layer of softer, more resilient material.

5. A construction in accordance with claim 4 wherein a plurality of said pad structures are positioned in rows and in closely spaced relationship on said front and back surfaces, said first-mentioned air-inflatable means substantially filling the space between the ends of the respective rows.

6. A construction in accordance with claim 1 wherein second means on the lower rear surface comprise a sub-combination including second air-inflatable sizing means and second energy-absorbing means on the lower rear inside surface of the shell, said second sizing means and second energy-absorbing means being alternately positioned, said second means controlling the inflation of said second sizing means, and wherein said second energy-absorbing means are of a type including first chambers holding a liquid and smaller second chambers communicating with said first chambers, said chambers being compressible and expandable whereby fluid is adapted to be displaced from said first chambers to said second chambers in response to an impact force and then returned to said first chambers upon removal of the impact force.

7. A construction in accordance with claim 6 wherein said sub-combination of second sizing means and second energy-absorbing means is substantially co-extensive with a row of said pad structures located on said back surface of the shell.

8. A construction in accordance with claim 7 including a first strip of relatively stiff plastic attached to said inner surface and encircling said first sizing and energy-absorbing means and said pad structures and providing a mounting therefor, and including a second strip attached to said inner surface beneath said first strip, said second sizing means and second energy-absorbing means being mounted on said second strip.

9. A construction in accordance with claim 1 including a strap attached to the inner shell surface removably supporting said pad structures whereby pad structures of different thicknesses can be mounted in the headgear to provide varying sizes.

* * * * *